US009255586B2

(12) United States Patent
Lee

(10) Patent No.: US 9,255,586 B2
(45) Date of Patent: Feb. 9, 2016

(54) DIFFUSER BLOCK AND DIFFUSER COMPRISING SAID DIFFUSER BLOCKS COMBINED WITH ONE ANOTHER

(71) Applicant: HANWHA TECHWIN CO.,LTD., Changwon-Si (KR)

(72) Inventor: Jin-Soo Lee, Changwon (KR)

(73) Assignee: Hanwha Techwin Co., Ltd., Changwon-si (KR)

( * ) Notice: Subject to any disclaimer, the term of this patent is extended or adjusted under 35 U.S.C. 154(b) by 359 days.

(21) Appl. No.: 13/667,531

(22) Filed: Nov. 2, 2012

(65) Prior Publication Data

US 2013/0115052 A1 May 9, 2013

(30) Foreign Application Priority Data

Nov. 3, 2011 (KR) ..... 10-2011-0114122

(51) Int. Cl.
*F04D 29/44* (2006.01)
*F04D 29/66* (2006.01)
*F01D 9/04* (2006.01)

(52) U.S. Cl.
CPC ..... *F04D 29/444* (2013.01); *F04D 29/663* (2013.01); *F04D 29/664* (2013.01); *F01D 9/045* (2013.01); *F05B 2260/96* (2013.01); *F05D 2260/96* (2013.01)

(58) Field of Classification Search
CPC ..... F01D 9/041; F01D 9/042; F01D 9/044; F01D 9/045; F04D 29/441; F04D 29/444; F04D 29/663; F04D 29/644; F04D 29/664; F05B 2260/96; F05D 2260/96
USPC ..... 415/119, 208.2–208.4, 211.1, 224.5, 415/207, 211.2
See application file for complete search history.

(56) References Cited

U.S. PATENT DOCUMENTS

| | | | | |
|---|---|---|---|---|
| 4,827,588 | A * | 5/1989 | Meyer | 29/889.22 |
| 5,592,820 | A | 1/1997 | Alary et al. | |
| 6,280,139 | B1 | 8/2001 | Romani et al. | |
| 2003/0161717 | A1* | 8/2003 | Liu | 415/1 |
| 2003/0235497 | A1* | 12/2003 | Meng | 415/208.3 |
| 2010/0189546 | A1* | 7/2010 | Liu et al. | 415/119 |
| 2010/0247303 | A1* | 9/2010 | Roberts, III | 415/200 |

FOREIGN PATENT DOCUMENTS

| | | | |
|---|---|---|---|
| JP | 2003512569 | A | 4/2003 |
| KR | 20010046697 | A | 6/2001 |
| KR | 100433324 | B1 | 5/2004 |

* cited by examiner

*Primary Examiner* — Christopher Verdier
(74) *Attorney, Agent, or Firm* — Sughrue Mion, PLLC

(57) ABSTRACT

Provided is a diffuser block used to form a diffuser with a plurality of the diffuser blocks, the diffuser block including: a body having a tube shape including an inner space provided inside the body, an inlet through which a fluid flows into the inner space and an outlet through which the fluid flows out of the inner space; and a first vane portion which protrudes toward the inner space from one side of the body.

14 Claims, 5 Drawing Sheets

DIFFUSER BLOCK AND DIFFUSER COMPRISING SAID DIFFUSER BLOCKS COMBINED WITH ONE ANOTHER

CROSS-REFERENCE TO RELATED PATENT APPLICATION

This application claims priority from Korean Patent Application No. 10-2011-0114122, filed on Nov. 3, 2011, in the Korean Intellectual Property Office, the disclosure of which is incorporated herein by reference in its entirety.

BACKGROUND

1. Field

Apparatuses consistent with exemplary embodiments relate to a diffuser formed by combining a plurality of diffuser blocks.

2. Description of the Related Art

Compressors that compress a fluid are essential components used in a power station, a jet engine, and the like, and have a function to increase pressure of the fluid. In particular, among compressors having various shapes, a centrifugal compressor is a machine that applies centrifugal force to a fluid by a rotatable impeller that performs compression by using the centrifugal force. The centrifugal compressor is commonly used in various apparatuses including a power source for producing a rotator power.

FIG. 1 is a schematic cross-sectional view of a related art centrifugal compressor 10, and FIG. 2 is a view showing a part of a diffuser 12 of the related art centrifugal compressor 10 shown in FIG. 1.

A fluid flowing into a shroud 13 of the related art centrifugal compressor 10 is flowed in an inlet of an impeller 11. The fluid meets the impeller 11 that is rotating, and thus static pressure and dynamic pressure of the fluid increase. In this process, the fluid having increased pressure moves to the outside of the impeller 11 along the shroud 13. Here, the dynamic pressure of the fluid is changed to the static pressure, and thus a greater compression effect may be exhibited. For this, a diffuser is used. FIG. 2 shows the diffuser 12 of the related art. The diffuser 12 is disposed outside of the impeller 11 and has a ring shape in which a hollow portion is formed in the center thereof. A plurality of vanes 12*b* is formed on a surface of a diffuser plate 12*a*. The diffuser 12 provides an outlet having a relatively wide cross-sectional area compared to an inlet of the diffuser 12. The diffuser 12 may change the dynamic pressure of the fluid to the static pressure according to a ratio of the cross-sectional area of the outlet of the diffuser 12 to that of the inlet of the diffuser 12. In other words, as the ratio of the cross-sectional area of the outlet to the cross-sectional area of the inlet of the diffuser 12 increases, an efficiency of changing from the aforesaid dynamic pressure to static pressure increases.

The fluid having the increased dynamic pressure and static pressure by the impeller 11 is flowed into the diffuser 12 along the shroud 13 that surrounds at least a part of the impeller 11, and when the fluid passes through the diffuser 12, an additional compression effect is generated while the dynamic pressure of the fluid is changed to static pressure. However, a significant level of noise is generated during this process, and the noise may decrease work efficiency and degrade marketability. In particular, most of the noise generated during operation of the related art centrifugal compressor 10 is generated due to flow separation occurring when the fluid passes through the diffuser 12. By reducing the noise generated during this process, the level of noise generated from the entire related art centrifugal compressor 10 may be lowered. Accordingly, there has been an increasing demand for a technology for reducing noise generated from the diffuser 12.

Also, the diffuser 12 that is used in the related art centrifugal compressor 10 has a structure in which the diffuser plate 12*a* and the vanes 12*b* formed on the surface of the diffuser plate 12*a* are integrally formed, as shown in FIG. 2, which requires a long processing time and a high manufacturing cost.

Accordingly, it will be beneficial to develop a diffuser having a new structure to resolve the noise problem and problems in manufacturing the diffuser from among problems of the related art centrifugal compressor.

SUMMARY

One or more exemplary embodiments provide a diffuser having a structure that may reduce noise and may be easily manufactured.

According to an aspect of an exemplary embodiment, there is provided a diffuser block used to form a diffuser with a plurality of the diffuser blocks, the diffuser block including: a body having a tube shape including an inner space provided inside the body, an inlet through which a fluid flows into the inner space and an outlet through which the fluid flows out of the inner space; and a first vane portion which protrudes toward the inner space from one side of the body.

The first vane portion may protrude such that a cross-sectional area of the inner space along a circumferential direction of the diffuser block increases in a direction from the inlet to the outlet.

The body may include a plurality of guide plates, and the first vane portion may be provided on a guide plate adjacent to an adjacent diffuser block.

The first vane portion may be combined with a second vane portion provided on a guide plate of the adjacent diffuser block to form an airfoil shape.

The first vane portion may be combined with a second vane portion provided on a guide plate of the adjacent diffuser block to form a wedge shape.

The first vane portion may be formed spaced apart from the inlet and the outlet.

The body includes a plurality of holes which connects the inner space and the outside of the body.

A sound-absorbing portion may be provided on an external surface of the body, wherein the holes may be formed in the external surface.

According to another aspect of an exemplary embodiment, there is provided a diffuser formed by combining a plurality of diffuser blocks, wherein each of the diffuser blocks includes: a body having a tube shape including an inner space provided inside the body, an inlet through which a fluid is flowed into the inner space and an outlet through which the fluid is flowed out of the inner space; and a first vane portion which protrudes toward the inner space from one side of the body.

According to yet another aspect of an exemplary embodiment, there is provided a diffuser having a ring shape formed by combining a plurality of diffuser blocks, wherein the diffuser including: a plurality of guide plates which forms a body of each of the plurality of diffuser blocks; a vane portion disposed between a first and second guide plates of the plurality of guide plates; a plurality of holes disposed on the plurality of guide plates; and a sound-absorbing portion disposed on the plurality of guide plates.

A fluid may enter an inner space of the body through an inlet and exits the inner space through an outlet, wherein the plurality of guide plates may form the inlet and the outlet and a third guide plate of the plurality of guide plates may include the vane portion.

The vane portion may include: a first vane portion disposed on a first diffuser block; and a second vane portion disposed on a second diffuser block, wherein the first diffuser block is adjacent to the second diffuser block.

The first vane portion may protrude toward the inner space such that a cross-sectional area of the inner space along a circumferential direction of the diffuser block increases in a direction from the inlet to the outlet.

BRIEF DESCRIPTION OF THE DRAWINGS

The above and other features and advantages of the disclosure will become more apparent by describing in detail exemplary embodiments thereof with reference to the attached drawings of which.

DETAILED DESCRIPTION

Hereinafter, the inventive concept will be described more fully with reference to the accompanying drawings, in which exemplary embodiments are shown. The inventive concept may, however, be embodied in many different forms and should not be construed as limited to the exemplary embodiments set forth herein. Rather, these embodiments are provided so that this disclosure will be thorough and complete, and will fully convey the scope of the inventive concept to those of ordinary skilled in the art. The terminology used herein is for the purpose of describing particular embodiments only and is not intended to be limiting of the inventive concept. As used herein, the singular forms 'a', 'an', and 'the' are intended to include the plural forms as well, unless the context clearly indicates otherwise. It will be further understood that the terms 'comprises' and/or 'comprising,' when used in this specification, specify the presence of stated features, integers, operations, elements, and/or components, but do not preclude the presence or addition of one or more other features, integers, operations, elements, components, and/or groups thereof. It will be understood that, although the terms 'first', 'second', 'third', etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept. As used herein, the term "and/or" includes any and all combinations of one or more of the associated listed items. Expressions such as "at least one of," when preceding a list of elements, modify the entire list of elements and do not modify the individual elements of the list.

Figure 3:
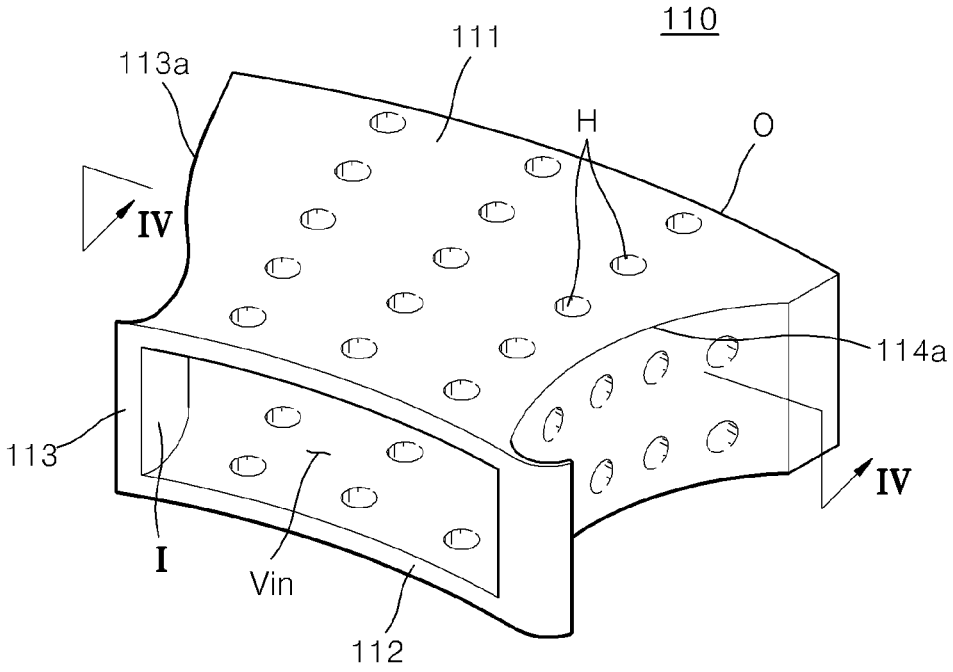
FIG. 3 is a perspective view of a body of a diffuser block according to an exemplary embodiment.
Figure 4:
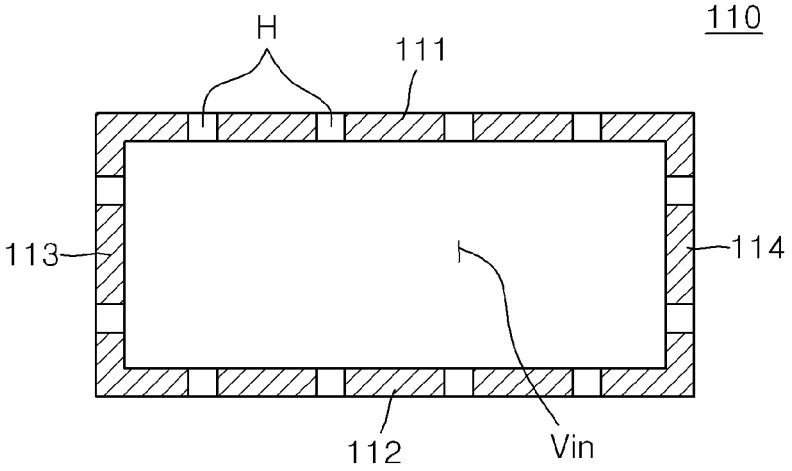
FIG. 4 is a cross-sectional view taken along line IV-IV of the body of the diffuser block shown in FIG. 3.

FIG. 3 is a perspective view of a body 110 of a diffuser block 100 (shown in FIG. 5), according to an exemplary embodiment. FIG. 4 is a cross-sectional view taken along line IV-IV of the body 110 of the diffuser block 100 shown in FIG. 3.

Figure 6:
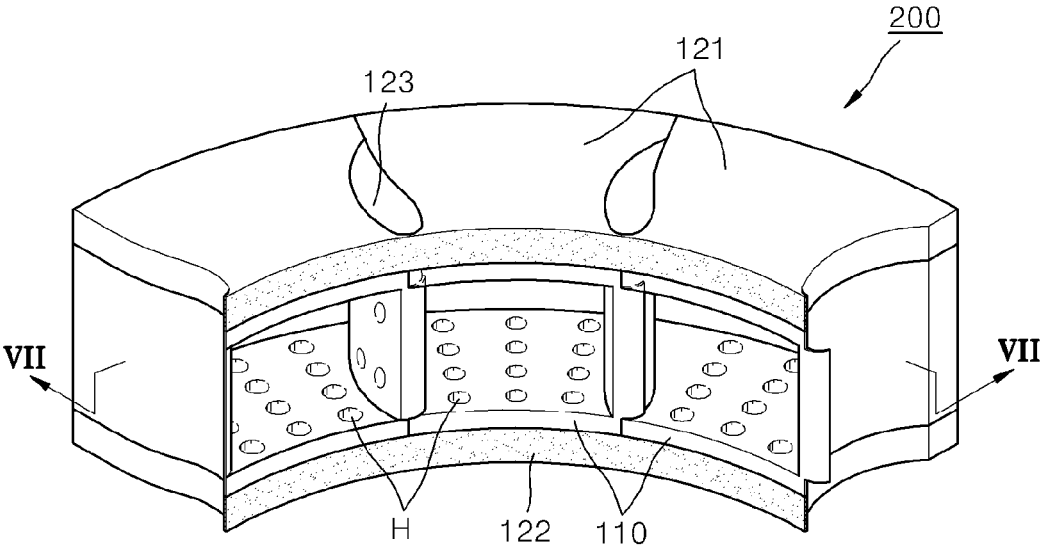
FIG. 6 is an enlarged view of part VI shown in FIG. 5.

A plurality of the diffuser blocks 100 combined with one another constitutes a diffuser 200 (shown in FIG. 6). Each of the diffuser blocks 100 may include the body 110, vane portions 113*a* and 114*a*, and sound-absorbing portions 121,122, 123.

An inner space $V_{in}$ is formed inside the body 110 of the diffuser block 100. The body 110 has a tube shape in which openings are respectively formed in both ends thereof so that a fluid flows into the inner space $V_{in}$.

The body 110 having a tube shape according to the exemplary embodiment includes four guide plates 111, 112, 113, and 114. The diffuser 200 is configured in such a way that a plurality of the bodies 110 are connected to one another in order to share edges at side surfaces thereof so that each of the guide plates 111, 112, 113, and 114 contacts other two guide plates.

The body 110 having a tube shape includes two openings through which a fluid flows in the inner space $V_{in}$ so that the body 110 serves as a diffuser. In other words, one of the two openings is an inlet I through which the fluid flows into the inner space Vin, and the other one that faces the inlet I is an outlet O through which the fluid that flowed into the inner space $V_{in}$ is discharged to the outside.

The four guide plates 111, 112, 113, and 114 of the body 110 may be referred to as an upper plate 111, a lower plate 112, a left plate 113, and a right plate 114, respectively. However, the exemplary embodiment is not limited thereto. The body 110 may include a different number of guide plates. The body 110 may be manufactured by welding the upper plate 111, the lower plate 112, the left plate 113, and the right plate 114 to one another. Alternatively, the body 110 may be manufactured by using a well-known process such as casting.

First, in the body 110 of the exemplary embodiment, the upper plate 111 and the lower plate 112 have the same shape and are disposed parallel to and spaced apart from each other. Edges of the upper and lower plates 111 and 112 near the inlet I and the outlet O are parts of an arc that shares the same virtual central point, and the edges have a curved shape. Also, a length of the edge near the outlet O, which is disposed farther from the virtual central point than the edge near the inlet I, is longer than a length of the edge near the inlet I. Thus, the diffuser block 100 includes the outlet O having a larger cross-sectional area than that of the inlet I, thereby functioning as a diffuser.

In addition, the diffuser block 100 may function as a diffuser by the vane portions 113*a* and 114*a* having a function as the vane 12*b* according to a related art technology. The vane portions 113*a* and 114*a* of the diffuser block 100 according to the exemplary embodiment protrude toward the inner space $V_{in}$ having a tube shape. The vane portions 113*a* and 114*a* according to the exemplary embodiment protrude in such a way that the left plate 113 and the right plate 114 are recessed toward the inner space $V_{in}$, and are formed as grooves formed along the left plate 113 and the right plate 114 from the edge near the left plate 113 and the edge near the right plate 114 of the upper plate 111 and the lower plate 112.

The vane portions 113*a* and 114*a* may be respectively formed in the left plate 113 and the right plate 114, which are guide plates adjacent to another diffuser block 100 when forming the diffuser 200. Each of the vane portions 113*a* and 114*a* forms a part of an airfoil shape. The vane portions 113*a* and 114*a* are combined with the vane portions 114*a* and 113*a* of another diffuser block 100, respectively, to form complete airfoil shapes. Thus, in the inner space $V_{in}$ formed inside the diffuser block 100, portions where the vane portions 113*a* and 114*a* are formed are formed in such a way that a cross-sectional area of a part of the inner space $V_{in}$ increases according to a direction in which a fluid moves.

However, the exemplary embodiment is not limited thereto. The diffuser block 100 may be formed in such a way that a vane portion protrudes toward an inner space of a body having a tube shape, as well as a vane portion formed as a curved portion recessed toward an inner space, may be additionally attached to a guide plate. Also, the shape of the vane portions 113*a* and 114*a* is not limited to an airfoil shape, and thus the vane portions 113*a* and 114*a* may have any of various shapes such as a wedge shape. However, when the vane portions 113*a* and 114*a* do not have a shape formed along a streamline, such as an airfoil shape, a pressure drop may occur during movement of a fluid, due to a flow separation phenomenon. Accordingly, the vane portions 113*a* and 114*a* may have a streamlined shape such as an airfoil shape.

The vane portions 113*a* and 114*a* that are respectively formed in the left plate 113 and the right plate 114 may be formed spaced apart from the inlet I and the outlet O so that the plurality of diffuser blocks 100 may be easily combined with one another to constitute the diffuser 200 and so that a compression property that may occur when the vane portions 113*a* and 114*a* are formed adjacent to the inlet I may be prevented from being additionally degraded due to the diffuser 200.

The diffuser block 100 having the above-described structure is just an exemplary embodiment, but the exemplary embodiment is not limited to the diffuser block 100. Thus, the diffuser block 100 may be modified in various ways. First, the vane portions 113*a* and 114*a* that protrude toward the inner space $V_{in}$ of the body 110 of the diffuser block 100 may not necessarily be disposed in the left plate 113 and the right plate 114, respectively. Thus, the vane portions 113*a* and 114*a* may be formed in the upper plate 111 and/or the lower plate 112. Also, as described above, the vane portions 113*a* and 114*a* that are respectively formed in two diffuser blocks 100 adjacent to each other may not necessarily be combined with each other to form one vane shape, and thus each diffuser block 100 may include one completed vane shape. If the vane portions 113*a* and 114*a* have the function of the vane 12*b* of the diffuser 12 shown in FIG. 2, the vane portions 113*a* and 114*a* may have any of various shapes.

Also, a plurality of holes H may be formed in the upper plate 111, the lower plate 112, the left plate 113, and the right plate 114 of the body 110. The sound-absorbing portions 121, 122,123 may be disposed on external surfaces of the upper plate 111, the lower plate 112, the left plate 113, and the right plate 114 to cover the holes H so as to absorb noise, which will be described below in detail.

Hereinafter, the diffuser 200, including the diffuser blocks 100 combined with one another, will be described.

Figure 5:
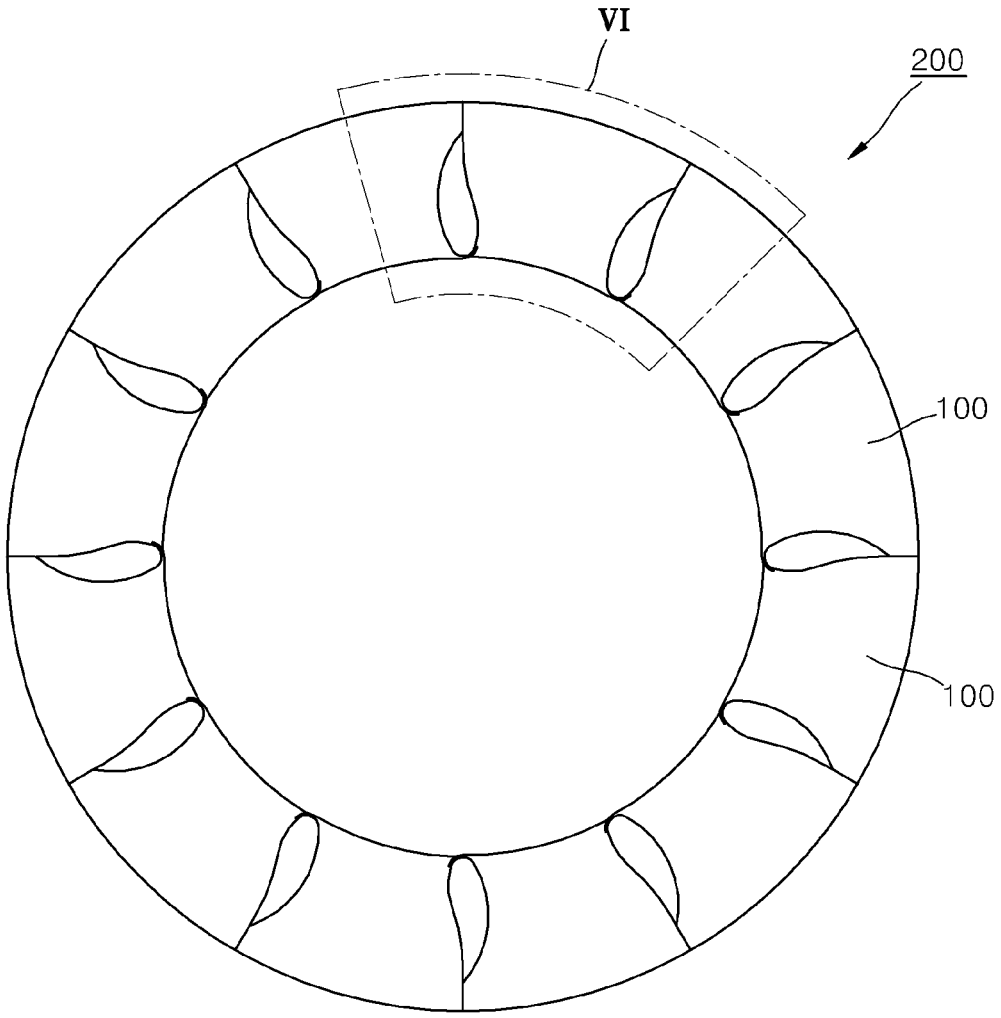
FIG. 5 shows a diffuser in which a plurality of the diffuser blocks shown in FIG. 3 are disposed.
Figure 7:
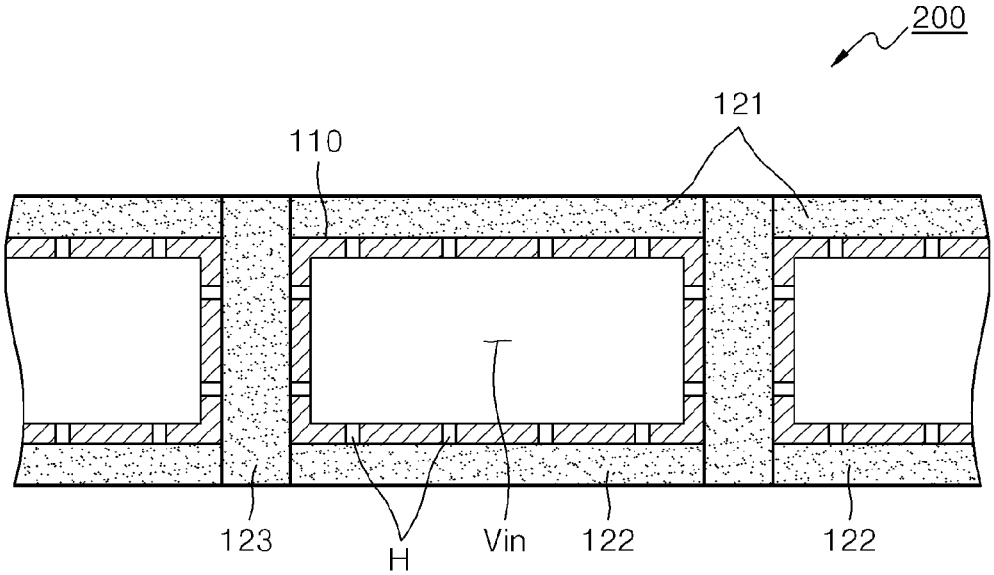
FIG. 7 is a cross-sectional view taken along line VII-VII of the diffuser shown in FIG. 6.
Figure 8:
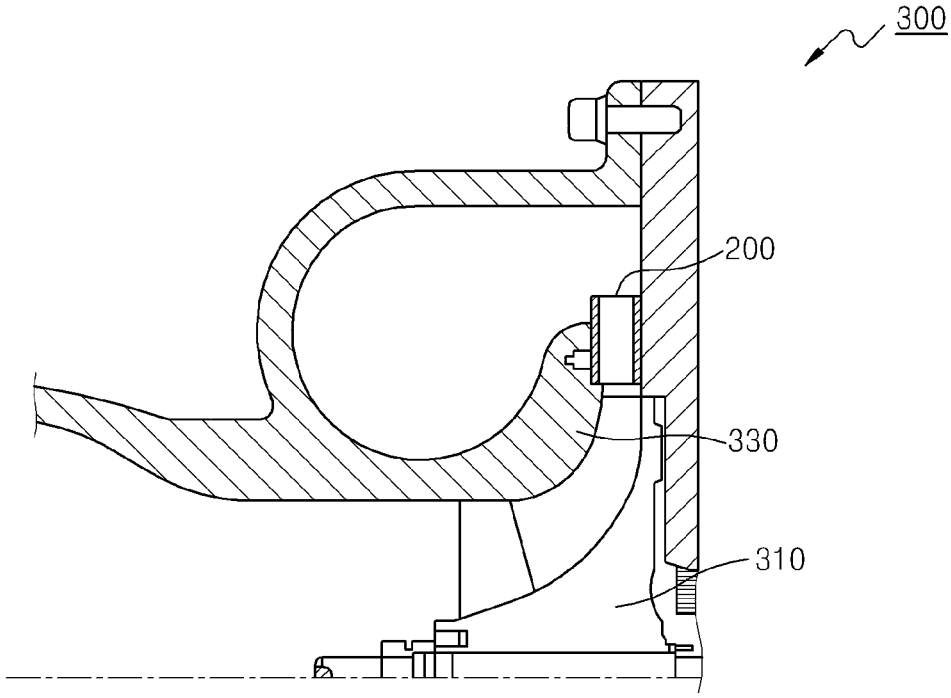
FIG. 8 is a schematic cross-sectional view of a centrifugal compressor in which the diffuser shown in FIG. 5 is disposed.

FIG. 5 shows the diffuser 200 in which the plurality of the diffuser blocks 100 shown in FIG. 3 are disposed. FIG. 6 is an enlarged view of part VI shown in FIG. 5. FIG. 7 is a cross-sectional view taken along line VII-VII of the diffuser 200 shown in FIG. 6. FIG. 8 is a schematic cross-sectional view of a centrifugal compressor 300 in which the diffuser 200 shown in FIG. 5 is disposed.

Figure 1:
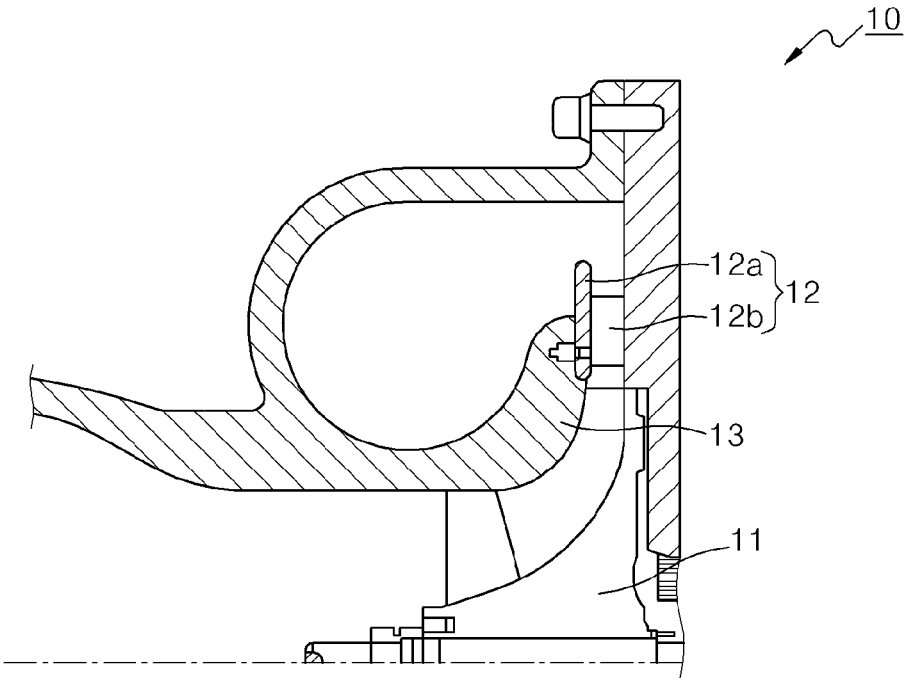
FIG. 1 Prior Art
FIG. 1 is a schematic cross-sectional view of a related art centrifugal compressor.
Figure 2:
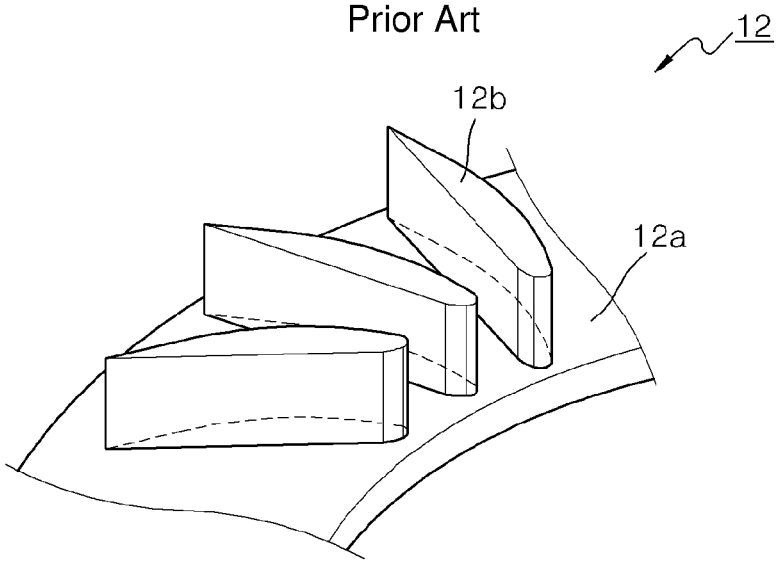
FIG. 2 Prior Art
FIG. 2 is a view showing a part of a diffuser of the related art centrifugal compressor shown in FIG. 1.

The diffuser blocks 100 are disposed to be connected to one another in a lateral direction. In other words, the left plate 113 of a certain diffuser block 100 may be combined with the right plate 114 of an adjacent diffuser block 100. Here, a well-known technology, such as welding or bonding using an adhesive material, may be used to combine the left plate 113 of the certain diffuser block 100 with the right plate 114 of the adjacent diffuser block 100. The diffuser blocks 100 combined with another in such a manner constitute a diffuser 200. The diffuser 200 has a ring shape as a whole as shown in FIG. 5. Also, the diffuser 200 has a shape in which both the vane portions 113*a* and 114*a* are supported by the upper plate 111 and the lower plate 112, unlike the diffuser 12, according to a related art technology, in which only one vane 12*b* is supported by the diffuser plate 12*a* as shown in FIG. 2. Since only one side of the vane 12*b* in a vane height direction is supported by the diffuser plate 12*a* in the diffuser 12, a part of the vane 12*b* may be damaged due to excessive stress that may be generated by fluid currents. Also, the damaged vane 12*b* may degrade a compression property due to the diffuser 12, and fragments of the damaged vane 12*b* may enter the impeller 11 or a cooler (not shown), thereby damaging components or obstructing discharge of condensation water. However, in the diffuser 200 according to the exemplary embodiment, since both sides of the vane portions 113*a* and 114*a* in a vane height direction are supported by the upper plate 111 and the lower plate 112, the above-described problems due to damage of the vane portions 113*a* and 114*a* may be prevented.

In particular, one end of the left plate 113 of the diffuser block 100 may surround one end of the right plate 114 of another adjacent diffuser block 100. In detail, the one end of the left plate 113 of the diffuser block 100 may protrude toward the right plate 114 of another adjacent diffuser block 100, and the right plate 114 of another adjacent diffuser block 100 may contact a part of the protruding portion of the left plate 113 of the diffuser block 100.

Also, the holes H may be formed in the upper plate 111, the lower plate 112, the left plate 113, and the right plate 114 of the body 110 of the diffuser block 100, and the sound-absorbing portions 121,122,123 may be disposed on the external surface of the upper plate 111, the lower plate 112, the left plate 113, and the right plate 114. The sound-absorbing portions 121,122,123 may include an upper plate sound-absorbing portion 121 and a lower plate sound-absorbing portion 122, which are respectively disposed on the upper plate 111 and the lower plate 112, and a lateral plate sound-absorbing portion 123 that is formed in an empty space formed by the vane portions 113*a* and 114*a*, which are formed between the left plate 113 and the right plate 114 of two diffuser blocks 100 adjacent to each other. The sound-absorbing portions 121,122,123 may absorb noise generated due to flow separation that may occur when a fluid passes through the inner space $V_{in}$ of the diffuser block 100 to reduce noise. In particular, when the holes H are formed in the upper plate 111, the lower plate 112, the left plate 113, and the right plate 114, the noise transferred through the holes H reaches the sound-absorbing portions 121,122,123 and is then absorbed by the sound-absorbing portions 121,122,123 without further reflection, and thus the whole noise is reduced. The sound-absorbing portions 121,122,123 may be formed of a well-known sound-absorbing material including polyurethane or polyester, or may be formed of a material having a function of absorbing noise. Also, the sound-absorbing portions 121,122, 123 may be formed of an epoxy material.

The diffuser 200 completed in such a manner is one module and may be installed in the centrifugal compressor 300, wherein an impeller 310 may be retracted into a hollow portion formed in the diffuser 200. A fluid flowing into a shroud 330 of centrifugal compressor 300 of the exemplary embodiment is flowed in an inlet of an impeller 310. The fluid meets the impeller 310 that is rotating, and thus static pressure and dynamic pressure of the fluid increase. Since the sound-absorbing portions 121,122,123 are disposed to contact the upper plate 111, the lower plate 112, the left plate 113, and the right plate 114, a sound-absorbing material does not need to be separately disposed after installing a diffuser as in a related art technology, thereby facilitating assembling. Also, since the sound-absorbing material is adhered onto the upper plate 111, the lower plate 112, the left plate 113, and the right plate 114 of the diffuser block 100, a high sound-absorbing effect may be achieved.

In addition, in the diffuser 12 according to a related art technology shown in FIG. 2, since the vane 12*b* and the diffuser plate 12*a* are integrally manufactured by means of machining, a manufacturing cost and a manufacturing time are increased. However, the diffuser 100 according to the exemplary embodiment may be manufactured through a simple process. That is, the diffuser blocks 100 are manufactured by casting or welding a plurality of plates, and the diffuser blocks 100 may be combined with one another by welding, thereby significantly reducing a manufacturing cost and a manufacturing time compared to the diffuser 12 manufactured according to a related art technology.

As described above, since vane portions formed in a diffuser are supported by plates, the vane portions may less likely to be damaged. If parts of the vane portions are damaged, the damaged parts may be easily repaired by replacing only some diffuser blocks including the damaged parts. Accordingly, a maintenance cost to repair or replace the diffuser may be reduced, and thus it is economically advantageous.

According to one or more exemplary embodiments, noise generated from a diffuser during operation of the diffuser can be reduced, and a manufacturing process of the diffuser may be facilitated.

While exemplary embodiments have been particularly shown and described above, it will be appreciated by those of ordinary skill in the art that various changes in form and details may be made therein without departing from the spirit and scope of the present inventive concept as defined by the following claims.

What is claimed is:

1. A diffuser block used to form a diffuser with a plurality of other diffuser blocks, the diffuser block comprising:
- a body having a tube shape comprising:
  - an inner space provided inside the body;
  - an inlet through which a fluid flows into the inner space; and
  - an outlet through which the fluid flows out of the inner space; and
- a first vane portion which protrudes toward the inner space from one side of the body,
- wherein the first vane portion is combined with a second vane portion provided on an adjacent diffuser block of the diffuser block to form an airfoil shape or a wedge shape, and
- wherein the first vane portion and the second vane portion comprise a plurality of holes which connects the inner space and an external surface of the body.

2. The diffuser block of claim 1, wherein the first vane portion protrudes such that a cross-sectional area of the inner space along a circumferential direction of the diffuser block increases in a direction from the inlet to the outlet.

3. The diffuser block of claim 1, wherein the body comprises a plurality of guide plates, and the first vane portion is provided on a guide plate adjacent to an adjacent diffuser block.

4. The diffuser block of claim 1, wherein the first vane portion is formed spaced apart from the inlet and the outlet.

5. A diffuser block used to form a diffuser with a plurality of other diffuser blocks, the diffuser block comprising:
- a body having a tube shape comprising:
  - an inner space provided inside the body;
  - an inlet through which a fluid flows into the inner space; and
  - an outlet through which the fluid flows out of the inner space; and
- a first vane portion which protrudes toward the inner space from one side of the body,
- wherein the body comprises a plurality of holes which connects the inner space and the outside of the body, and
- wherein a sound-absorbing portion is provided on an external surface of the body, wherein the holes are formed in the external surface.

6. A diffuser formed by combining a plurality of diffuser blocks, wherein each of the diffuser blocks comprises:
- a body having a tube shape comprising:
  - an inner space provided inside the body;
  - an inlet through which a fluid flows into the inner space; and
  - an outlet through which the fluid flows out of the inner space; and
- a first vane portion which protrudes toward the inner space from one side of the body,
- wherein the first vane portion is combined with a second vane portion provided on an adjacent diffuser block of the diffuser block to form an airfoil shape or a wedge shape, and
- wherein the first vane portion and the second vane portion comprise a plurality of holes which connects the inner space and an external surface of the body.

7. The diffuser of claim 6, wherein the first vane portion protrudes such that a cross-sectional area of the inner space along a circumferential direction of the diffuser block increases in a direction from the inlet to the outlet.

8. The diffuser of claim 6, wherein the body comprises a plurality of guide plates, and the first vane portion is provided on a guide plate adjacent to an adjacent diffuser block.

9. The diffuser of claim 6, wherein the first vane portion is formed spaced apart from the inlet and the outlet.

10. A diffuser formed by combining a plurality of diffuser blocks, wherein each of the diffuser blocks comprises:
- a body having a tube shape comprising:
  - an inner space provided inside the body;
  - an inlet through which a fluid flows into the inner space; and
  - an outlet through which the fluid flows out of the inner space; and
- a first vane portion which protrudes toward the inner space from one side of the body,
- wherein the body comprises a plurality of holes which connects the inner space and the outside of the body, and
- wherein a sound-absorbing portion is provided on an external surface of the body, wherein the holes are formed in the external surface.

11. A diffuser having a ring shape formed by combining a plurality of diffuser blocks, wherein the diffuser comprises:
- a plurality of guide plates which forms a body of each of the plurality of diffuser blocks;

a vane portion disposed between first and second guide plates of the plurality of guide plates;

a plurality of holes disposed on the plurality of guide plates and the vane portion; and a sound-absorbing portion disposed on an external surface of each of the plurality of guide plates and the vane portion.

12. The diffuser of claim 11, wherein a fluid enters an inner space of the body through an inlet and exits the inner space through an outlet, wherein the plurality of guide plates forms the inlet and the outlet and a third guide plate of the plurality of guide plates comprises the vane portion.

13. The diffuser of claim 12, wherein the vane portion comprises:

a first vane portion disposed on a first diffuser block; and a second vane portion disposed on a second diffuser block, wherein the first diffuser block is adjacent to the second diffuser block.

14. The diffuser of claim 13, wherein the first vane portion protrudes toward the inner space such that a cross-sectional area of the inner space along a circumferential direction of the diffuser block increases in a direction from the inlet to the outlet.

* * * * *